US008261909B2

(12) United States Patent
Sorrentino et al.

(10) Patent No.: US 8,261,909 B2
(45) Date of Patent: Sep. 11, 2012

(54) DISPLAY PACKAGE FOR A PLURALITY OF PRODUCTS

(75) Inventors: Alan Sorrentino, Cranbury, NJ (US); Andreas Haefliger, Triengen (CH)

(73) Assignee: Colgate-Palmolive Company, New York, NY (US)

( * ) Notice: Subject to any disclaimer, the term of this patent is extended or adjusted under 35 U.S.C. 154(b) by 29 days.

(21) Appl. No.: 12/886,095

(22) Filed: Sep. 20, 2010

(65) Prior Publication Data

US 2011/0068044 A1 Mar. 24, 2011

Related U.S. Application Data

(60) Provisional application No. 61/243,981, filed on Sep. 18, 2009.

(51) Int. Cl.
*B65D 75/00* (2006.01)

(52) U.S. Cl. ..... 206/362.4; 206/354; 206/526; 206/779

(58) Field of Classification Search ..... 229/87.13; 206/352, 354, 526, 466, 461, 434, 779, 362, 206/362.4
See application file for complete search history.

(56) References Cited

U.S. PATENT DOCUMENTS

| | | | |
|---|---|---|---|
| D196,988 | S | 11/1963 | Wills, Jr. |
| D197,862 | S | 3/1964 | Wills, Jr. |
| 3,721,335 | A | 3/1973 | Grant |
| 3,759,375 | A | 9/1973 | Nappi |
| RE31,571 | E | 5/1984 | Mann |
| 4,512,474 | A | 4/1985 | Harding |
| 4,703,856 | A | 11/1987 | Chaussadas |
| D294,123 | S | 2/1988 | Hill |
| 4,759,935 | A | 7/1988 | Toshitsugu |
| 4,779,734 | A | 10/1988 | Kydonieus |
| 4,785,160 | A | 11/1988 | Hart |
| D306,404 | S | 3/1990 | Hill |
| 5,018,622 | A | 5/1991 | Hartley |
| 5,022,525 | A | 6/1991 | Schuster |
| 5,031,939 | A | 7/1991 | Webendorfer et al. |
| 5,048,684 | A | 9/1991 | Scott |
| D320,930 | S | 10/1991 | Richards |
| 5,082,112 | A | 1/1992 | Dunklee |
| 5,094,347 | A | 3/1992 | Schuster |
| 5,121,835 | A | 6/1992 | Grupe |

(Continued)

FOREIGN PATENT DOCUMENTS

EP 0 556 836 A1 8/1993

(Continued)

OTHER PUBLICATIONS

Partial International Search Report for corresponding International Application No. PCT/US2010/049491 dated Nov. 29, 2010.

(Continued)

*Primary Examiner* — David Fidei
(74) *Attorney, Agent, or Firm* — Judy W. Chung

(57) ABSTRACT

The present invention is directed to a display package that, in one embodiment, comprises a plurality of packs containing one or more products and a sleeve. The primary packs are arranged in a bundle and disposed within the sleeve. A separator panel can be included in certain embodiments of the bundle between the packs. Portions of the packs may protrude through apertures in the front and rear panels of the sleeve and apertures within the separator panel to assist with maintaining the bundle within the sleeve.

24 Claims, 11 Drawing Sheets

U.S. PATENT DOCUMENTS

| | | | |
|---|---|---|---|
| 5,129,527 | A | 7/1992 | Lataix |
| 5,158,177 | A | 10/1992 | Negelen et al. |
| 5,207,066 | A | 5/1993 | Bova et al. |
| 5,209,354 | A | 5/1993 | Thornhill et al. |
| 5,226,534 | A | 7/1993 | Kim |
| 5,244,091 | A | 9/1993 | Tannenbaum |
| 5,264,036 | A | 11/1993 | Haas et al. |
| 5,265,728 | A | 11/1993 | Allendorf et al. |
| 5,297,673 | A | 3/1994 | Sutherland |
| D346,114 | S | 4/1994 | Winston |
| 5,311,984 | A | 5/1994 | Harris |
| D347,998 | S | 6/1994 | Steenwinkel |
| 5,323,904 | A | 6/1994 | Katagiri et al. |
| D352,236 | S | 11/1994 | Althaus |
| 5,390,784 | A | 2/1995 | Sutherland |
| 5,390,848 | A | 2/1995 | Gungner et al. |
| 5,407,066 | A | 4/1995 | Grange |
| 5,414,890 | A | 5/1995 | Morando |
| 5,439,112 | A | 8/1995 | DeGuglielmo et al. |
| 5,443,203 | A | 8/1995 | Sutherland |
| 5,447,232 | A | 9/1995 | Chow |
| D365,984 | S | 1/1996 | Hofmann |
| 5,489,025 | A | 2/1996 | Romick |
| 5,520,283 | A | 5/1996 | Sutherland |
| 5,524,756 | A | 6/1996 | Sutherland |
| 5,540,381 | A | 7/1996 | Davis |
| 5,542,536 | A | 8/1996 | Sutherland |
| 5,549,197 | A | 8/1996 | Sutherland |
| 5,549,204 | A | 8/1996 | Toren |
| D373,306 | S | 9/1996 | Baxter |
| 5,595,047 | A | 1/1997 | Paumen et al. |
| 5,595,291 | A | 1/1997 | Negelen |
| 5,624,036 | A | 4/1997 | Roulin et al. |
| 5,653,340 | A | 8/1997 | Daniel |
| 5,671,845 | A | 9/1997 | Harris |
| 5,682,995 | A | 11/1997 | Sutherland |
| 5,685,420 | A | 11/1997 | Martin et al. |
| 5,803,264 | A | 9/1998 | Gersten et al. |
| 5,845,776 | A | 12/1998 | Galbierz et al. |
| 5,855,275 | A | 1/1999 | Hunter et al. |
| 5,887,706 | A | 3/1999 | Pohle et al. |
| D408,278 | S | 4/1999 | Konop |
| 5,921,392 | A | 7/1999 | Davis |
| 5,957,289 | A | 9/1999 | Negelen |
| 5,984,086 | A | 11/1999 | Foushee et al. |
| D419,063 | S | 1/2000 | Baker et al. |
| 6,012,573 | A | 1/2000 | Kurimoto |
| 6,015,043 | A | 1/2000 | Sanberg et al. |
| 6,024,222 | A | 2/2000 | Friberg et al. |
| D421,898 | S | 3/2000 | Strange |
| D423,927 | S | 5/2000 | Senyuva et al. |
| D425,414 | S | 5/2000 | Baker et al. |
| 6,059,106 | A | 5/2000 | Baker et al. |
| 6,116,420 | A | 9/2000 | Hall et al. |
| D432,414 | S | 10/2000 | Simpson et al. |
| 6,138,828 | A | 10/2000 | Bendix |
| 6,227,369 | B1 | 5/2001 | Glassman |
| D449,780 | S | 10/2001 | Corella |
| 6,296,120 | B1 | 10/2001 | Danko |
| D451,382 | S | 12/2001 | Adkins |
| D455,071 | S | 4/2002 | Ruben |
| 6,364,115 | B1 | 4/2002 | Casanova et al. |
| 6,378,765 | B1 | 4/2002 | Sutherland |
| D461,713 | S | 8/2002 | Foreman |
| 6,478,336 | B2 | 11/2002 | Tran |
| D470,046 | S | 2/2003 | Chao |
| D471,443 | S | 3/2003 | Chiang |
| D472,140 | S | 3/2003 | Yang |
| D478,810 | S | 8/2003 | Wilson |
| 6,615,985 | B1 | 9/2003 | Foreman |
| 6,651,846 | B2 | 11/2003 | Danquet et al. |
| D484,798 | S | 1/2004 | Bukowski |
| 6,726,011 | B2 | 4/2004 | Sarkar et al. |
| 6,736,260 | B2 | 5/2004 | Gomes et al. |
| 6,758,338 | B2 | 7/2004 | Lien |
| D501,792 | S | 2/2005 | Priestman |
| 6,877,600 | B2 | 4/2005 | Sutherland |
| D504,811 | S | 5/2005 | Haingaertner |
| 6,889,829 | B2 | 5/2005 | Lev et al. |
| 6,889,840 | B2 | 5/2005 | Schein et al. |
| D506,146 | S | 6/2005 | Hall |
| D506,147 | S | 6/2005 | Hall |
| D506,397 | S | 6/2005 | Hall |
| D507,756 | S | 7/2005 | Hall |
| 6,920,980 | B2 | 7/2005 | Hwang et al. |
| D512,330 | S | 12/2005 | Hall |
| D513,596 | S | 1/2006 | Hamblin et al. |
| 6,988,617 | B2 | 1/2006 | Gomes et al. |
| D515,941 | S | 2/2006 | Hamblin et al. |
| D515,942 | S | 2/2006 | Hamblin et al. |
| D515,943 | S | 2/2006 | Hamblin et al. |
| 6,997,372 | B2 | 2/2006 | Gasparowicz |
| 7,021,458 | B2 | 4/2006 | Cummings |
| D525,866 | S | 8/2006 | Oliveira |
| 7,083,046 | B2 | 8/2006 | Bakx |
| 7,097,034 | B2 | 8/2006 | Woog |
| D531,026 | S | 10/2006 | McMorris |
| D532,612 | S | 11/2006 | Lamason et al. |
| D536,609 | S | 2/2007 | Moskovich et al. |
| D548,619 | S | 8/2007 | Ferguson et al. |
| D552,466 | S | 10/2007 | Proudfit |
| D558,602 | S | 1/2008 | Kissner et al. |
| 7,341,153 | B2 | 3/2008 | DuBois et al. |
| 7,374,038 | B2 | 5/2008 | Smalley |
| 7,464,818 | B2 | 12/2008 | Gherdan et al. |
| 2001/0054570 | A1 | 12/2001 | Danko |
| 2003/0213705 | A1 | 11/2003 | Woog |
| 2004/0108236 | A1 | 6/2004 | Reed et al. |
| 2004/0182733 | A1 | 9/2004 | Dunlap |
| 2005/0045526 | A1 | 3/2005 | Constant et al. |
| 2005/0082194 | A1 | 4/2005 | Fry et al. |
| 2006/0042988 | A1 | 3/2006 | Hjalmarsson |
| 2006/0049240 | A1 | 3/2006 | LeBras |
| 2006/0102512 | A1 | 5/2006 | Lo Duca |
| 2006/0113215 | A1 | 6/2006 | Clements |
| 2006/0157545 | A1 | 7/2006 | Auclair |
| 2006/0255108 | A1 | 11/2006 | Shmagin |
| 2006/0278561 | A1 | 12/2006 | Schierlmann |
| 2007/0187429 | A1 | 8/2007 | Farahmand |
| 2007/0235367 | A1 | 10/2007 | Initini |
| 2007/0272586 | A1 | 11/2007 | Hession |
| 2008/0011637 | A1 | 1/2008 | Young et al. |
| 2008/0023472 | A1 | 1/2008 | Brandt |
| 2008/0087568 | A1 | 4/2008 | Jabri |
| 2008/0156675 | A1 | 7/2008 | Sandow |
| 2008/0302695 | A1 | 12/2008 | Meeren et al. |

FOREIGN PATENT DOCUMENTS

| | | | |
|---|---|---|---|
| EP | 0 627 906 | | 12/1994 |
| EP | 0 648 686 | | 4/1995 |
| EP | 0 777 617 | | 6/1997 |
| EP | 0 784 022 | A1 | 7/1997 |
| EP | 1 343 701 | | 9/2003 |
| EP | 1 349 727 | | 10/2003 |
| EP | 1 477 426 | | 11/2004 |
| EP | 1 504 693 | | 2/2005 |
| EP | 1553020 | | 7/2005 |
| EP | 1 723 049 | | 11/2006 |
| EP | 1 723 980 | A1 | 11/2006 |
| EP | 1 931 578 | | 6/2008 |
| EP | 1957378 | A1 | 8/2008 |
| GB | 2327218 | | 1/1999 |
| WO | WO 95/17116 | | 6/1995 |
| WO | WO 96/01769 | | 1/1996 |
| WO | WO 01/36291 | | 5/2001 |
| WO | WO 03/072446 | | 9/2003 |
| WO | WO 2004/026723 | | 4/2004 |
| WO | WO 2005/014437 | | 2/2005 |
| WO | WO 2006/119992 | | 11/2006 |
| WO | WO 2008/016630 | | 2/2008 |
| WO | WO 2008/039248 | | 4/2008 |

OTHER PUBLICATIONS

International Search Report and Written Opinion in international Application No. PCT/US10/049491 mailed Jul. 1, 2011.

DISPLAY PACKAGE FOR A PLURALITY OF PRODUCTS

CROSS-REFERENCE TO RELATED PATENT APPLICATIONS

The present patent application claims the benefit of U.S. Provisional Patent Application No. 61/243,981, filed Sep. 18, 2009, the entirety of which is hereby incorporated by reference.

FIELD

The present invention relates generally to product packaging that displays the products contained therein, and specifically to product packaging that displays the products contained therein that includes a primary package and a secondary package.

BACKGROUND

Many products are sold in bulk packaging which contain two or more of the subject products. In many instances, it is desirable to display the subject products in an organized and aesthetically pleasing manner to potential consumers, while the products remain in the bulk packaging. Display of the products themselves at the point of sale has proven to be a significant factor that positively influences consumer reaction to and/or evaluation of a product, thus, ultimately leading to increased sales. However, the aforementioned goal of product display (especially in bulk packaging) has been limited by the desire to maintain packaging costs as low as possible. Moreover, the requirements that bulk packaging also be structurally stable and versatile in display have also presented significant hurdles in the field. It is further desirable, especially in display packaging, that the packaging be capable of both resting on a store shelf and being suspended from a peg (or similar member) that extends outwardly from a vertical support with no or minimal alteration. It is also desirable that the display packaging be easily storable by the end consumer, especially in bulk packaging in which the products may be used over an extended period of time. To this extent, it has been desired to utilize packaging that is sleek, small in size, and easily portable and/or stackable. Finally, all product packaging should have sufficient structural stability so as to prevent damage to the products (and the packaging itself) during shipping and/or handling.

SUMMARY

The present invention is directed to a display package that, in one embodiment, comprises a plurality of primary packs that contain one or more products and a sleeve. The primary packs are arranged in a bundle and disposed within the sleeve. Preferably, the display package can be stood upright or hung from a peg or other member extending from a vertical wall.

In certain embodiments, a separator panel may be provided to prevent the primary packs from decoupling from one another and/or sliding out of the sleeve. The separator panel may also add rigidity to the display package. Apertures may be provided in opposing panels of the sleeve for receiving portions of the primary packs of the bundle to further facilitate retention of the bundle within the sleeve.

In one embodiment, the invention can be a display package comprising: a plurality of packs, each pack comprising a front wall, a rear wall, and at least one interior chamber located between the front and rear walls for holding at least one product, the plurality of packs arranged in a bundle; a separator panel having at least one upper aperture and at least one lower aperture positioned between adjacent packs in the bundle, a portion of the front wall of one pack in the bundle protruding through one of the upper or lower apertures in the separator panel and contacting an adjacent pack in the bundle and a portion of the rear wall of the adjacent pack in the bundle protruding through the other one of the upper or lower apertures in the separator panel and contacting the one pack in the bundle; a sleeve comprising a front panel having a front aperture, a rear panel having a rear aperture, and first and second side panels connecting the front and rear panels to form a cavity; and the bundle positioned within the cavity of the sleeve, a portion of the front wall of a front-most pack in the bundle protruding through the front aperture of the front panel of the sleeve and a portion of the rear wall of a rear-most pack in the bundle protruding through the rear aperture of the rear panel of the sleeve.

In another embodiment, the invention can be a display package comprising: a first pack and a second pack, each of the first and second packs comprising a front wall, a rear wall, and at least one interior chamber located between the front and rear walls for holding at least one product; the first and second packs arranged in a bundle so that a protruding portion of the front wall of the second pack contacts the first pack and a protruding portion of the rear wall of the first pack contacts the second pack; a sleeve comprising a front panel having a front aperture, a rear panel having a rear aperture, and first and second side panels connecting the front and rear panels to form a cavity; and the bundle positioned within the cavity of the sleeve, a protruding portion of the front wall of the first pack protruding through the front aperture of the front panel of the sleeve and a protruding portion of the rear wall of the second pack protruding through the rear aperture of the rear panel of the sleeve In yet another aspect, the invention can be a display package comprising: a plurality of packs, each pack comprising a front wall, a rear wall, and at least one interior chamber located between the front and rear walls for holding at least one product, the plurality of packs arranged in a bundle; a separator panel positioned between adjacent packs in the bundle and having at least one aperture that allows contact between the adjacent packs in the bundle; a tubular sleeve comprising a front panel having a front aperture and a rear panel having a rear aperture; and the bundle positioned within the cavity of the tubular sleeve, a protruding portion of the front wall of a front-most pack in the bundle protruding through the front aperture of the front panel of the tubular sleeve and a protruding portion of the rear wall of a rear-most pack in the bundle protruding through the rear aperture of the rear panel of the sleeve.

In a further aspect, the invention can be a carton blank comprising: a front panel comprising a front aperture; a first side panel and a second side panel appended to opposite sides of the front panel; a rear panel appended to the first side panel opposite the front panel, the rear panel comprising a pull tab and a rear aperture, the pull tab located adjacent a free side edge of the rear panel opposite the first side panel; and a glue flap extending from the second side panel opposite the front panel for coupling to the rear panel at a location adjacent the pull tab.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION

Figure 1:
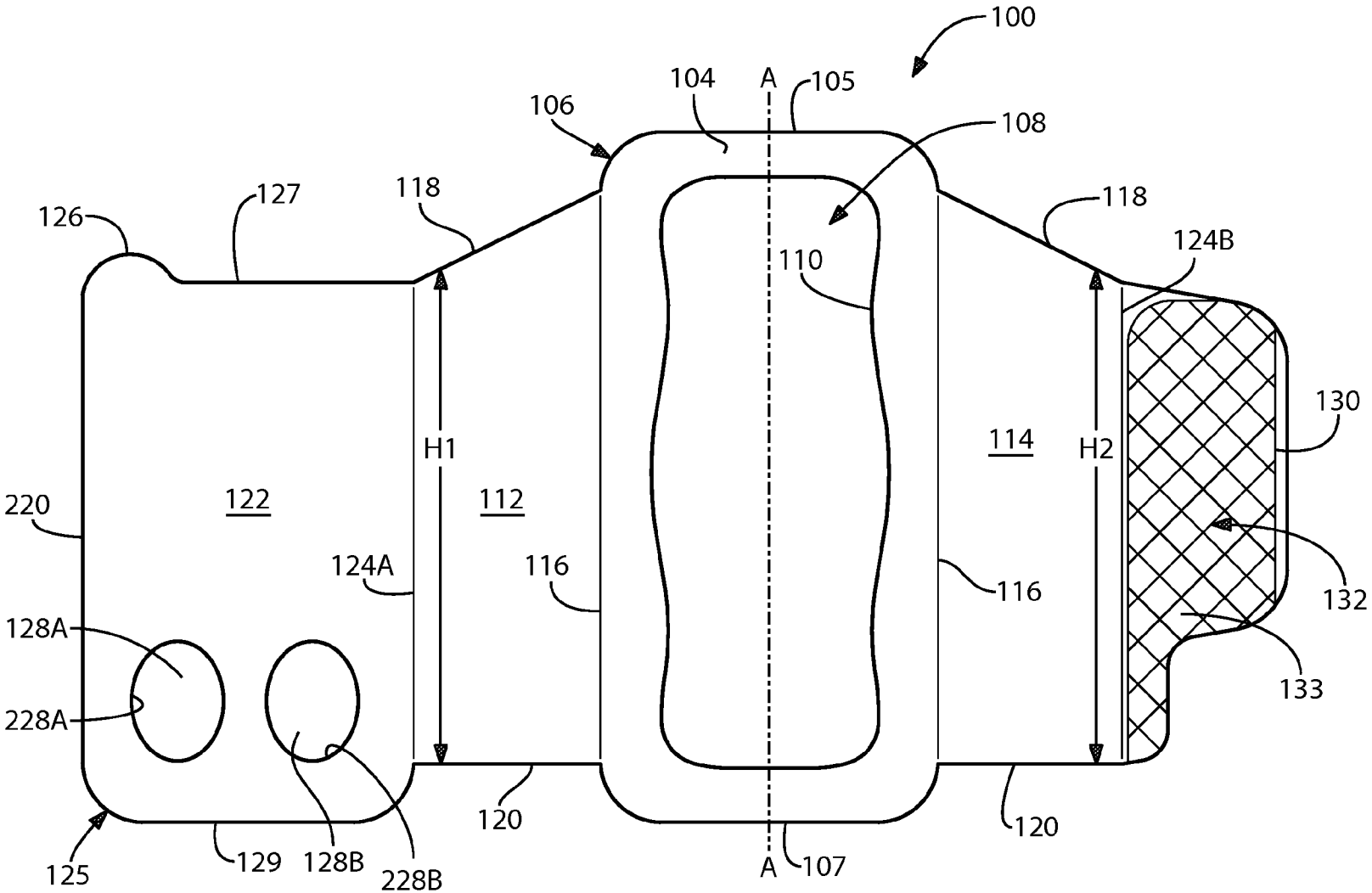
FIG. 1 is a plan view of a carton blank according to an embodiment of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower." "upper," "horizontal," "vertical," "above," "below," "up", "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Referring first to FIG. 1, a carton blank 100 according to one embodiment of the present invention is illustrated. The carton blank 100, when assembled, forms a sleeve 102 (discussed in detail below with respect to FIGS. 2 and 3). The carton blank 100 is preferably constructed of paperboard, but can be constructed of other sheet-like materials, including without limitation cardboard, plastics, paper, thick foils and/or combinations thereof. The paperboards can be virgin folding box boards and bleached boards. Also various grades of recycled paperboards can be used. The useful paperboards include various Swissboards. The paperboards preferably have a weight of about 250 to about 500 g/m$^2$ and a thickness of about 0.25 millimeter to about 1.5 millimeters. The carton blank 100 generally comprises a front panel 104, a first side panel 112, a second side panel 114, a rear panel 122 and a glue flap 130, all of which are appended together as described below.

The front panel 104 has a top edge 105 and a bottom edge 107 and is substantially rectangular in shape with rounded corners 106. The top edge 105 and the bottom edge 107 of the front panel 104 are substantially parallel to one another and normal to a longitudinal axis A-A of the front panel 104. Of course, the front panel 104 can take on a wide variety of shapes, none of which are considered limiting of the present invention, unless specifically stated as such.

The front panel 104 further includes a front aperture 108 extending through the panel that acts as a display window. The front aperture 108 is defined by a closed-geometry aperture edge 110. In the exemplified embodiment, the aperture edge 110 is contoured such that the aperture edge 110 is shaped to correspond to a perimeter of a portion of one the packs 150, 152 (FIG. 5) that is intended to protrude from the front aperture 108. The front aperture 108 is preferably a sufficiently large window that allows the entirety of at least one of the products in a front-most pack 150 to be displayed therethrough. In one embodiment, the front aperture 108 is centralized and comprises at least a majority of the surface area of the front panel 104 so that the front panel 104 is effectively a frame about the front aperture 108. Of course, the front aperture 108 may take on any shape or size known to a person having ordinary skill in the art that enables at least a portion of one of the packs 150, 152 to protrude therethrough (as described in greater detail below).

The first and second side panels 112, 114 are appended to the front panel 104 along weakened areas/lines 116 on opposing sides of the front panel. The weakened areas/lines 116 allow the first and second side panels 112, 114 to be folded out of plane with respect to the front panel 104. The weakened areas/lines 116 can be formed by any method known in the art, including without limitation perforating, creasing, pressing, thinning, scoring, and/or combinations thereof. It is further preferable that the weakened areas/lines 116 extend substantially parallel to a longitudinal axis A-A of the front panel 104.

The first and second side panels 112 and 114 extend away from the front panel 104 in opposite directions. Each of the first and second side panels 112 and 114 include a top edge 118 and a bottom edge 120. The top edges 118 of the first and second side panels 112, 114 extend away from the front panel 104 at an oblique angle measured with respect to the longitudinal axis A-A of the front panel 104. To the contrary, the bottom edges 120 of the first and second side panels 112, 114 extend away from the front panel 104 at a normal angle measured with respect to a longitudinal axis A-A of the front panel 104. The oblique angles are preferably selected such that the heights H1, H2 of the first and second side panels 112, 114 decrease moving away from the front panel 104. Thought of another way, the oblique angles are preferably selected so that the top and bottom edges 118, 120 of each of the first and second side panels 112, 114 extend from the front panel 104 in a converging manner.

The rear panel 122 is appended to the first side panel 112 along weakened area/line 124A. The rear panel 122 is appended to a side of the first side panel 112 that is opposite the side of the first side panel 112 to which the front panel 104 is appended. The weakened area/line 124A allows the rear panel 122 to be folded out of plane with respect to the first side panel 112. The weakened area/line 124A can be formed by any method known in the art, including without limitation perforating, creasing, pressing, thinning, scoring, and/or combinations thereof. It is further preferable that the weakened area/line 124A extend substantially parallel to the longitudinal axis A-A of the front panel 104.

The rear panel 122 comprises a top edge 127, a bottom edge 129, and a free side edge 220. The rear panel 122 is substantially rectangular in shape with rounded corners 125 delimiting the bottom edge 129. Of course, the rear panel 122 can take on a wide variety of shapes, none of which are considered limiting of the present invention, unless specifically stated as such. Both the top and bottom edges 127, 129 of the rear panel 122 extend substantially normal to the longitudinal axis A-A of the front panel 104. Furthermore, it is preferred that the bottom edge 129 of the rear panel 122 and the bottom edge 107 of the front panel 104 are substantially coplanar with one another (even when assembled into the sleeve 102). As discussed in greater detail below, the coplanar nature of the bottom edge 129 of the rear panel 122 and the bottom edge 107 of the front panel 104 provides the display package 1000 with the ability to stand upright when positioned on a horizontal surface.

The rear panel 122 further comprises a pull tab 126 located adjacent to the free side edge 220. In the exemplified embodiment, the pull tab 126 extends/protrudes from the top edge 127 and forms an extension of the free side edge 220. The pull tab 126 enables a user to grasp the rear panel 122 with their finger to open the display package 1000 (described in more detail below). Of course, the pull tab 126 may be located at different positions on the rear panel 122. For example, the pull tab 126 may extend from the free side edge 220 or may extend from the rear major surface of the rear panel 122.

At least one rear aperture, and preferably a plurality of rear apertures 128A, 128B, are formed in the rear panel 122. In the exemplified embodiment, the rear panel 122 comprises first and second rear apertures 128A, 128B. Each of the rear apertures 128A, 128B are separately defined by a closed-geometry rear aperture edge 228A, 228B. The rear apertures 128A, 128B are provided in the rear panel 122 so that a protruding portion of a rear-most pack 152 extends through each of the rear apertures 128A, 128B (discussed in greater detail below). The rear apertures 128A, 128B are preferably aligned with one another and located proximate the bottom edge 129 of the rear panel 122. In the exemplified embodiment, the rear apertures 128A, 128B are elliptical in shape but can take on a wide variety of shapes. Moreover, the rear panel 122 may include more or less than two rear apertures 128A, 128B as desired, and can be positioned in alternate locations on the rear panel 122.

The carton blank 100 further comprises a glue flap 130 that is appended to the second side panel 114 along the weakened area/line 124B. The glue flap 130 is appended to a side of the second side panel 114 that is opposite the side of the second side panel 114 to which the front panel 104 is appended. The weakened area/line 124B allows the glue flap 130 to be folded out of plane with respect to the second side panel 112. When the carton blank 100 is assembled into the sleeve 102, the glue flap 130 and the rear panel 122 extend substantially parallel to one another and the glue flap 130 is coupled to an inner surface of the rear panel 122 adjacent the free side edge 220 and the pull tab 126. The weakened area/line 124B can be formed by any method known in the art, including without limitation perforating, creasing, pressing, thinning, scoring, and/or combinations thereof. It is further preferable that the weakened area/line 124B extend substantially parallel to the longitudinal axis A-A of the front panel 104.

The glue flap 130 includes an adhesive 132 applied thereto that couples the glue flap 130 to an inner surface of the rear panel 122. The glue flap 130 further comprises a notch 133 formed therein. When the carton blank 100 is assembled into the sleeve 102, the notch 133 overlies at least one of the rear apertures 128A, 128B so that the structure of the glue flap 130 does not obstruct the rear apertures 128A, 128B.

Figure 2:
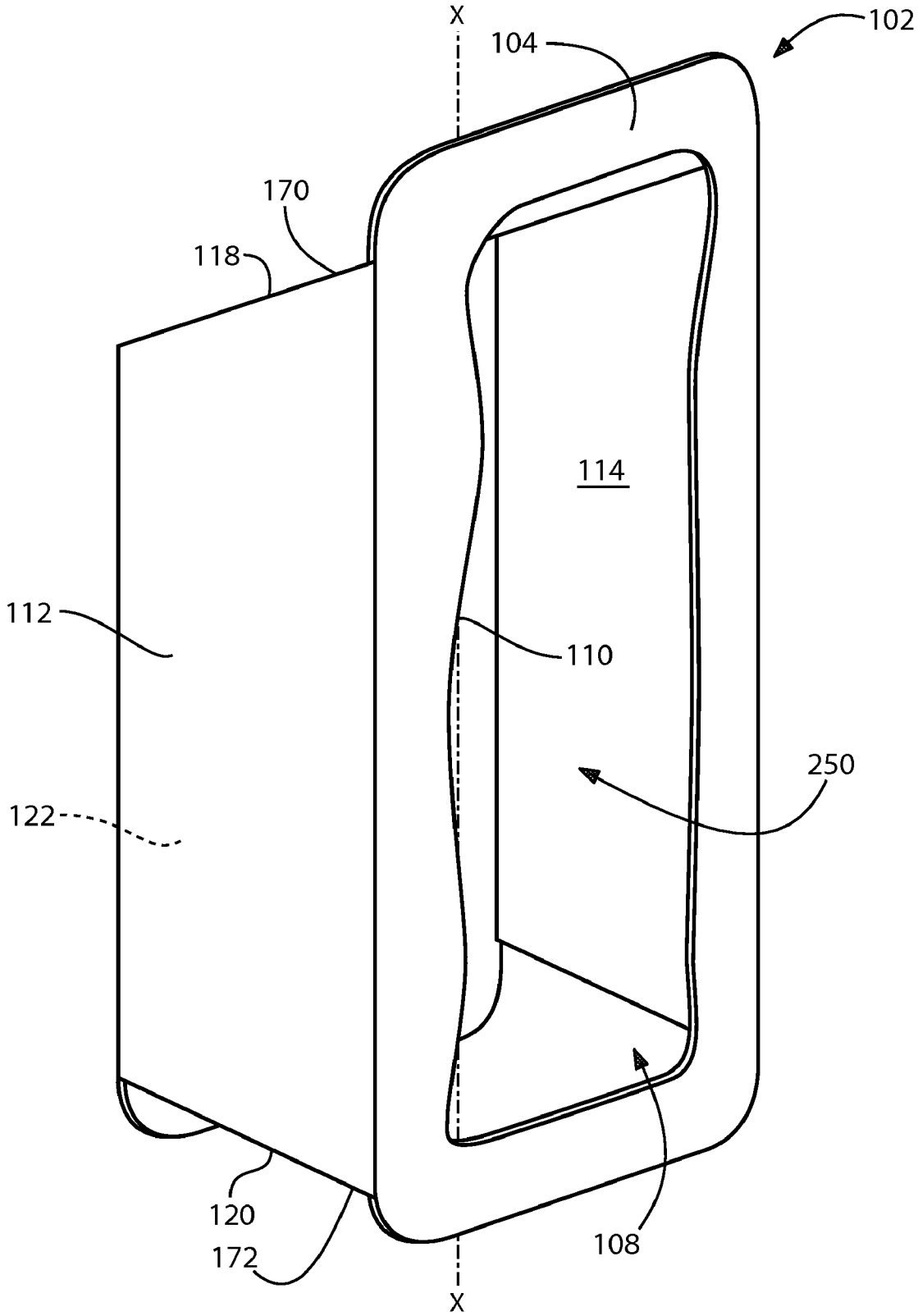
FIG. 2 is a front perspective view a sleeve formed by the assembly of the carton blank of FIG. 1.
Figure 3:
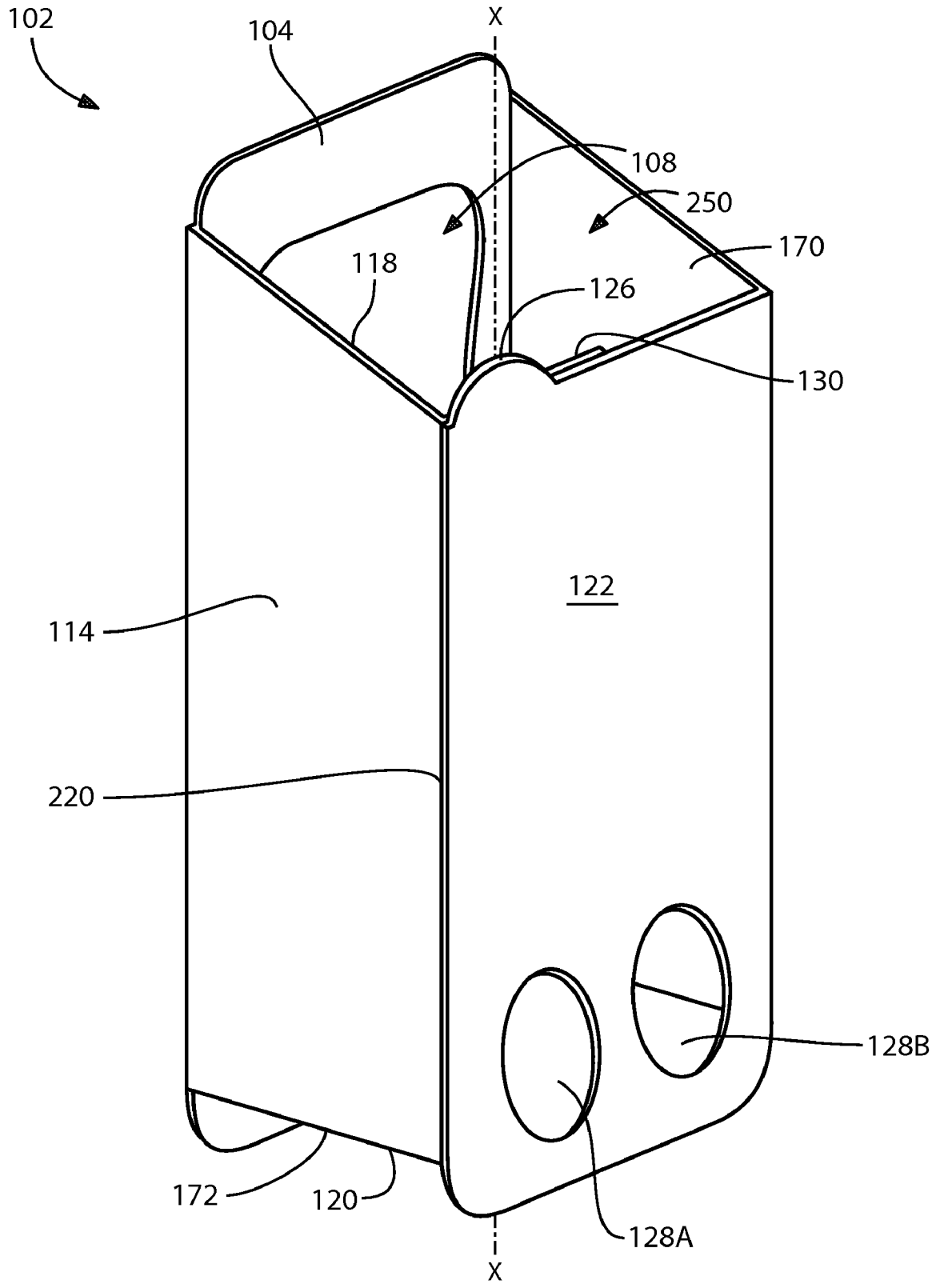
FIG. 3 is a rear perspective view of the sleeve formed by the assembly of the carton blank of FIG. 1.

Referring now to FIGS. 2 and 3 concurrently, a sleeve 102 formed by the assembly (i.e., folding and coupling) of the carton blank 100 is illustrated. In order to assemble the sleeve 102 out of the carton blank 100, the first and second side panels 112 and 114 are folded along the weakened areas/lines 116 such that the first and second side panels 112 and 114 extend substantially normal to the front panel 104 and substantially parallel to one another. The glue flap 130 is then folded along the weakened area/line 124B such that the glue flap 130 extends substantially normal to the second side panel 114 and substantially parallel to the front panel 104. The rear panel 122 is then folded along the weakened area/line 124A such that rear panel 122 extends substantially normal to the first side panel 112 and substantially parallel to the front panel 104 (and the rear panel 122). At this point, the glue flap 130 is adjacent to and in contact with the rear panel 122. The glue flap 130 is then coupled to the inner surface of the rear panel 122 using the adhesive 132, thereby forming the sleeve 102. In one embodiment of forming the display package 1000, a bundle 167 is formed first and then the sleeve 102 is formed about the bundle 167 (discussed in greater detail below with reference to FIG. 5).

When the sleeve 102 is assembled as described above, the glue flap 130 is coupled to the rear panel 122 adjacent the free side edge 220 of the rear panel and adjacent to the pull tab 126. By nature of the relative positioning discussed above, a user could pull on the pull tab 126 to decouple the rear panel 122 from the glue panel 130 without compromising the overall integrity of the sleeve 102.

The sleeve 102 is a generally tubular structure that forms a cavity 250 for receiving the bundle 167 of packs 150, 152 (discussed below). The cavity 250 is formed about a central axis X-X. The sleeve 102 circumferentially surrounds the central axis X-X and has an open top end 170 and an open bottom end 172, each of which forms an axial passageway into the cavity 250. While the sleeve 102 is exemplified as having a substantially rectangular transverse cross-sectional profile, the sleeve 102 could be designed to have a wide variety of transverse cross-sectional profiles, including without limitation elliptical, polygonal, combinations thereof, or irregular shaped. In an embodiment where an elliptical transverse cross-sectional profile is used, the front panel, the rear panel and the first and second side panels would simply be portions of the elliptical wall. Moreover, while the sleeve 102 comprises both an open top end 170 and an open bottom end 172, in alternative embodiments, one or both of the top and bottom ends 170, 172 may be closed.

As can be seen, the front aperture 108 of the front panel 104 forms a transverse passageway into the cavity 250. Similarly, each of the rear apertures 128A, 128B of the rear panel 122 form a transverse passageway into the cavity 250.

Figure 4:
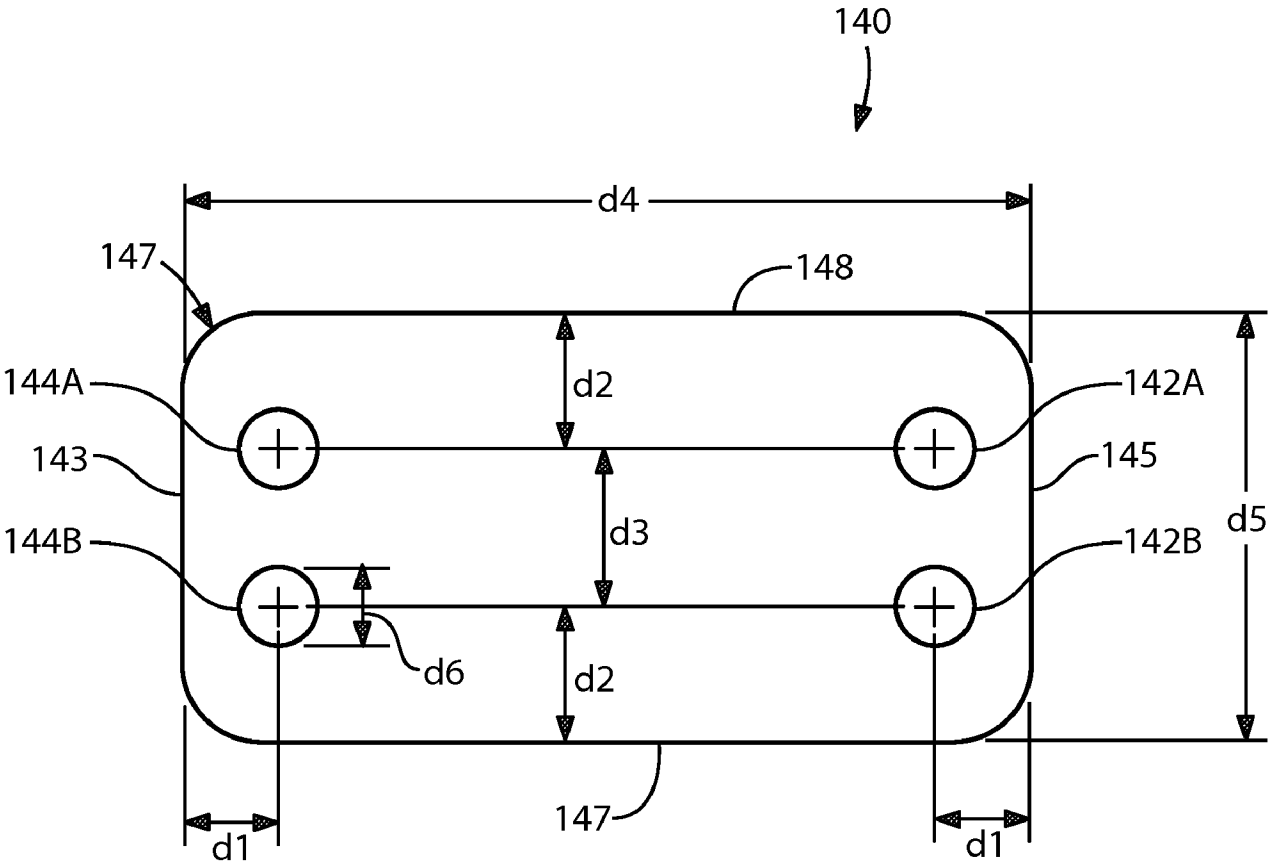
FIG. 4 is a plan view of a separator panel ha can be used in conjunction with the carton blank of FIG. 1.

Referring now to FIG. 4, a separator panel 140 is illustrated according to an embodiment of the present invention. As discussed in detail below, the separator panel 140 is used to separate and maintain the relative positioning of the packs 150, 152 with respect to one another and with respect to the sleeve 200. In the exemplified embodiment, the separator panel 140 is substantially rectangular-shaped. However, the separator panel 140 can take on a wide variety of shapes. The separator panel 140 is preferably constructed of paperboard, but can be constructed of other sheet-like materials, including without limitation cardboard, plastics, paper, thick foils and/or combinations thereof. The paperboards can be virgin folding box boards and bleached boards. Also various grades of recycled paperboards can be used. The useful paperboards include various Swissboards. The paperboards preferably have a weight of about 250 to about 500 g/m$^2$ and a thickness of about 0.25 millimeter to about 1.5 millimeters.

The separator panel 140 includes a top edge 143, a bottom edge 145, a first side edge 147 and a second side edge 148, which collectively form a perimetric edge of the separator panel 140. First and second upper apertures 144A, 144B are formed into the separator panel 140 proximate the top edge 143 of the separator panel 140. Similarly, first and second lower apertures 142A, 142B are formed into the separator panel 140 proximate the bottom edge 1435 of the separator panel 140. As discussed in detail below, the first and second upper apertures 144A, 144B and the first and second lower apertures 142A, 142B form passageways through the separator panel 140 to provide access ways through which the packs 150, 152 can contact one another when the bundle 167 is formed. Of course, more or less apertures can be provided in the separator panel 140 as desired. For example in certain embodiments, a single aperture may be provided. Moreover, the location of the aperture(s) in the separator panel 140 may also be varied as desired.

The first and second upper apertures 144A, 144B are aligned with one another relative to the top edge 143 while the first and second lower apertures 142A, 142B are aligned with one another relative to the bottom edge 145. The center of the upper apertures 144A, 144B are positioned a distance d1 from the top edge 143. Similarly, the center of the lower apertures 142A, 142B are also positioned a distance d1 from the bottom edge 145. The centers of both the first upper aperture 144A and the first lower aperture 142A are positioned a distance d2 from the second side edge 148. Similarly, the centers of both the second upper aperture 144B and the second lower aperture 142B are positioned a distance d2 from the first side edge 147. In one embodiment, d1 may be a range of 10 millimeters (mm) to 14 mm and d2 may be a range of 15 mm to 20 mm. In another embodiment, d1 may be about 12.25 mm and d2 may be about 17.25 mm.

The centers of the first and second upper apertures 144A, 144B are spaced a distance d3 from one another. Similarly, the centers of the first and second lower apertures 142A, 142B are spaced a distance d3 from one another. In one embodiment, d3 may be a range of 16 mm to 24 mm. In another embodiment, d3 may be about 20 mm. Moreover, the separator panel 140 may have a length of d4 and a width of d5. In one embodiment, d4 may be a range of 80 mm to 120 mm and d5 may be a range of 45 mm to 65 mm. In another embodiment, d4 may be about 108 mm and d5 may be about 54.5 mm. Further, each of the upper and lower apertures 142A-B, 144A-B may have a diameter of d6. In one embodiment, d6 may be a range of 7 mm to 13 mm. In another embodiment, d6 may be about 10 mm. It should be known to a person having ordinary skill in the art that the size and number of the apertures can be varied as needed.

In the exemplary embodiment, the upper and lower apertures 144A-B, 142A-B are substantially elliptical. However, in alternative embodiments, the upper and lower apertures 144A-B, 142A-B may have any shape. Further, the separator panel 140 includes a plurality of corners 147 that are substantially rounded. In an alternative embodiment, the corners 147 may be any shape such as, but not limited to, square-shaped.

Figure 5:
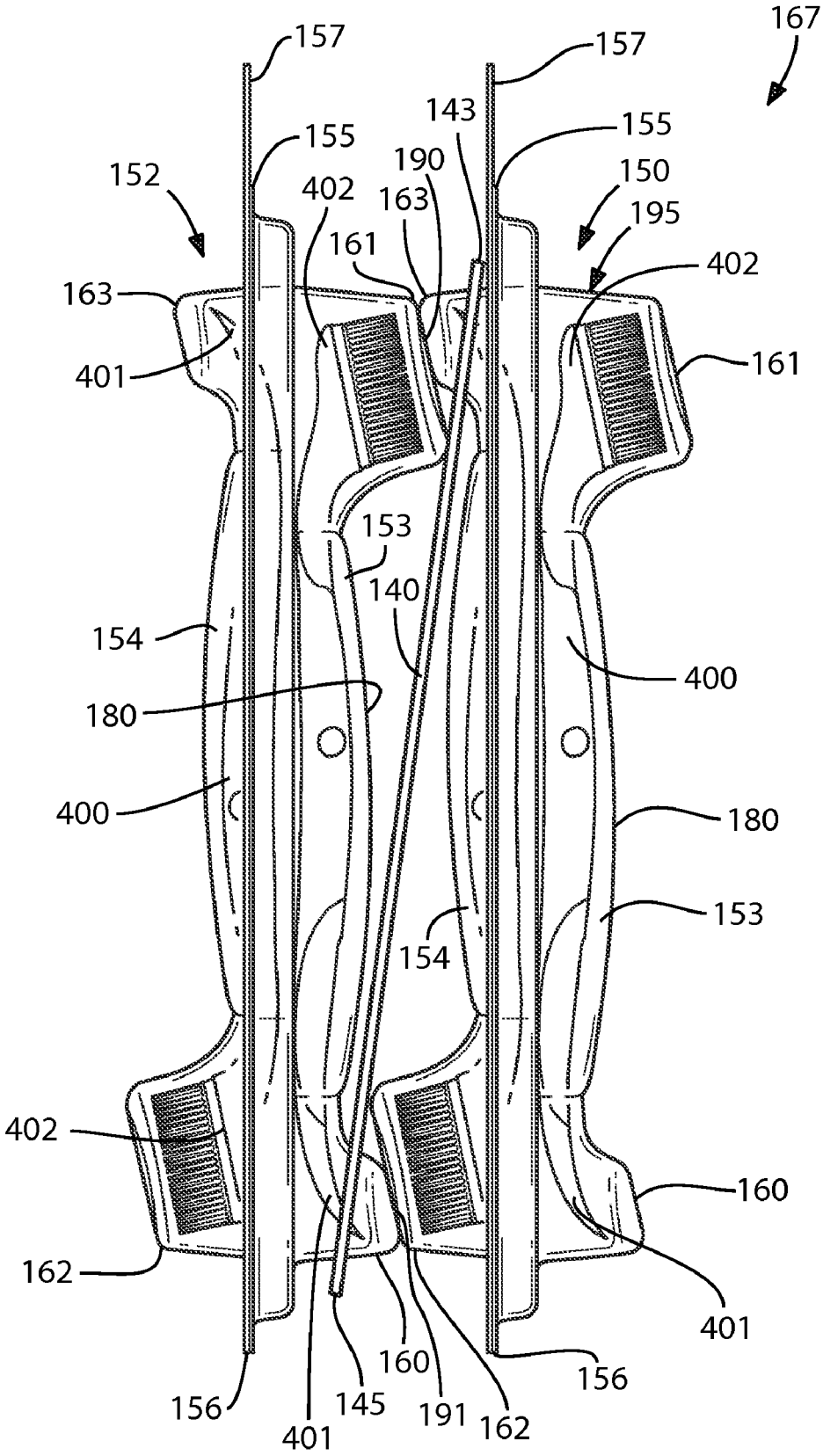
FIG. 5 is a side view of a bundle including two primary packs and the separator panel of FIG. 2 disposed therebetween that can be used in conjunction with the carton blank of FIG. 1.

Referring now to FIG. 5, a bundle 167 according to the present invention is illustrated. The bundle 167 generally comprises a first pack 150, a second pack 152, and the separator panel 140 disposed between the first and second packs 150, 152. The first pack 150 and the second pack 152 are arranged in a horizontal stack within the bundle 167 with portions thereof extending through the apertures 144A-B, 142A-B of the separator panel 140. The first and second packs 150, 152 are preferably identical to one another in all aspects, including structure, shape and size. In one preferred embodiment, the first and second packs 150, 152 are blister packs that are formed of a material, such as a thermoformed polymeric material, that is sufficiently transparent so that the products 400 contained therein are visible to a consumer through the first and second packs 150, 152. Blister packs are well known in the art and need no further discussion. While two packs 150, 152 and one separator panel 140 are exemplified in the bundle 167, it is to be understood that the invention is not so limited and the bundle 167 may include more packs and/or separator panels 140 as desired. Moreover, in certain embodiments of the invention, while not preferred, the separator panel 140 may be omitted from the bundle 167.

Figure 11:
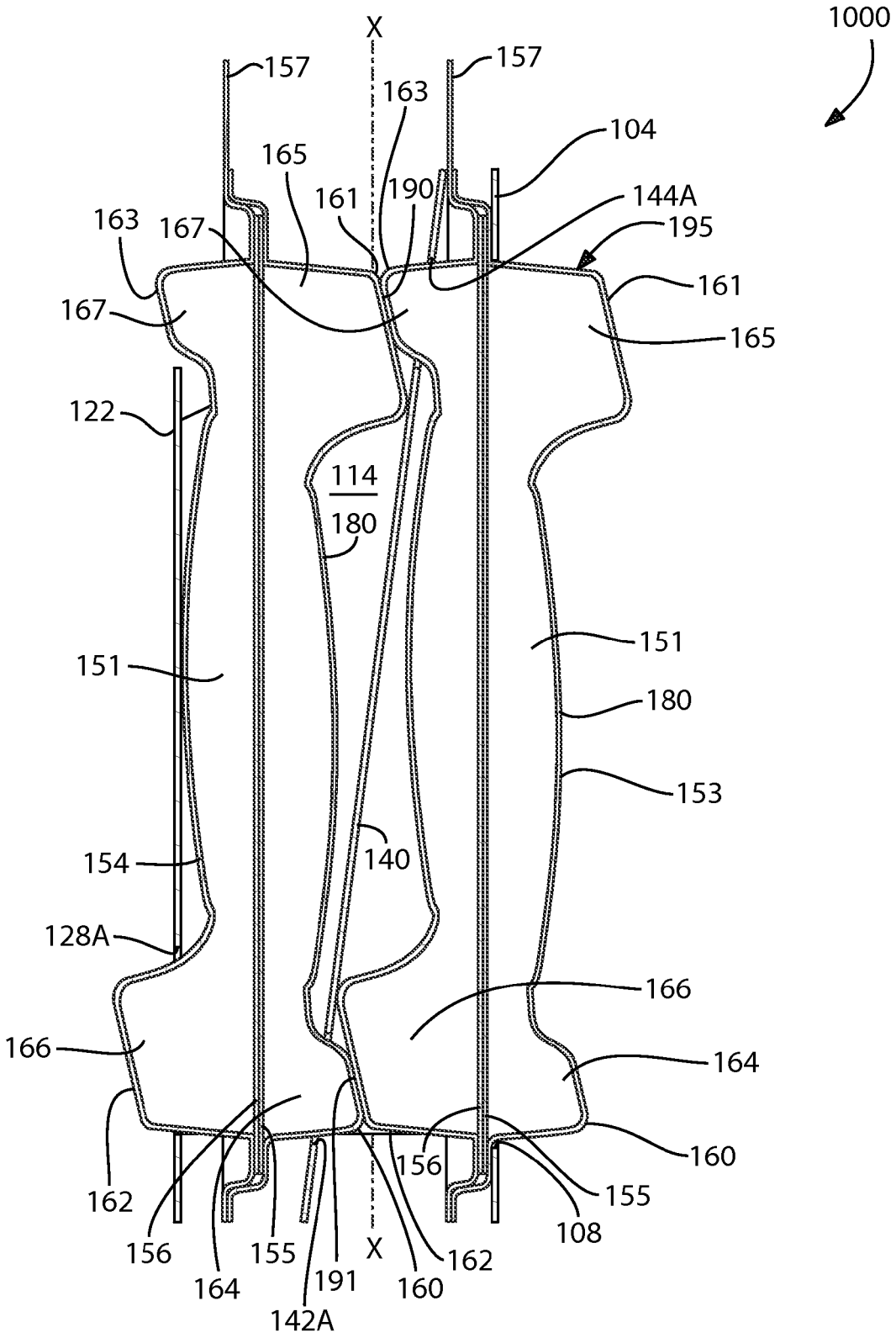
FIG. 11 is cross-sectional schematic of the display package of FIG. 6 taken along line XI-XI of FIG. 7.

Referring now to FIGS. 5 and 11 concurrently, each of the packs 150, 152 comprises a front wall 153, a rear wall 154, and at least one interior chamber 151 located between the front and rear walls 153, 154. In the exemplified embodiment, each of the packs 150, 152 comprises four interior chambers 151, two located between the front wall 153 and a first foil layer 155 and two formed between the rear wall 154 and a second foil layer 156 (FIG. 11). A desired product 400, in the form of a disposable toothbrush, is positioned within each of the interior chambers 151. Of course, each pack 150, 152 can contain more or less interior chambers 151 as desired. For each of the packs 150, 152, the front wall 153 is hingedly connected to the rear wall 154 so that the packs 150, 152 can be opened by the user to access the interior chambers 151 individually.

The front wall 153 and the rear wall 154 of each of the packs 150, 152 are contoured, thereby forming the interior chambers 151 therein (best shown in FIG. 11). The front wall 153 of each of the packs 150, 152 comprises lower protruding portions 160 and upper protruding portions 161 extending in a first direction. Similarly, the rear wall 154 of each of the packs 150, 152 comprises lower protruding portions 162 and upper protruding portions 163 extending in a second direction opposite the first direction. In the exemplified embodiment, the lower protruding portions 160 of the front wall 153 form a portion 164 of the interior chamber 151 in which a handle portion 401 of the toothbrush 400 nests while the upper protruding portions 161 of the front wall 153 form a portion 165 of the interior chamber 151 in which a head portion 402 of the toothbrush 400 nests. Oppositely, the lower protruding portions 162 of the rear wall 154 form a portion 166 of the interior chamber 151 in which a head portion 402 of the toothbrush 400 nests while the upper protruding portions 163 of the rear wall 154 form a portion 167 of the interior chamber 151 in which a head portion 402 of the toothbrush 400 nests. Such orientation of the products 400 is referred to as a "head-to-tail" arrangement, which reduces the amount of space between the packs. This reduced space between the primary packs 150, 152 requires less material to be used in manufacturing the sleeve 102. Thus, achieving a reduction in waste and cost over a package that does not include the head-to-tail arrangement. Of course, the present invention is not limited by the type of product stored therein or the orientation of the product(s) within the packs.

The interaction between two adjacent packs in the bundle 167 will now be discussed in relation to the first pack 150, the second pack 152, and the separator panel 140. When positioned in the bundle 167, the upper protruding portions 163 of the rear wall 154 of the first pack 150 extend through the upper apertures 144A, 144B of the separator panel 140 and contact the front wall 153 of the second pack 152, and more specifically, contact the upper protruding portions 161 of the front wall 153 of the second pack 152. Concurrently, the lower protruding portions 160 of the front wall 153 of the second pack 152 extend through the lower apertures 142A, 142B of the separator panel 140 and contact the rear wall 154 of the first pack 150, and more specifically, contact the lower protruding portions 162 of the rear wall 154 of the first pack 150. The lower protruding portions 162 of the rear wall 154 of the first pack 150 are too large to fit through the lower apertures 142A, 142B of the separator panel 140. Similarly, the upper protruding portions 161 of the front wall 153 of the second pack 152 are too large to fit through the upper apertures 144A, 144B of the separator panel 140.

The upper protruding portions 163 of the rear wall 154 of the first pack 150 and the upper protruding portions 161 of the front wall 153 of the second pack 152 contact each other so as to form a first planar contact interface 190. Similarly, the lower protruding portions 160 of the front wall 153 of the second pack 152 contact the lower protruding portions 162 of the rear wall 154 of the first pack 150 so as to form a second planar contact interface 191. The first and second contact interfaces 190, 191 are arranged at an oblique angle relative to the central axis X-X (when the display package is fully assembled). Furthermore, when arranged in the bundle 167 as described above, the separator panel 140 is also oriented at an oblique angle relative to the central axis X-X (when the display package is fully assembled). In fact, the first and second contact interfaces 190, 191 are also oriented at an oblique angle relative to the separator panel 140.

The separator panel 140 facilitates stabilization of the package bundle 167 both internally and with respect to the sleeve 102 when the display package 1000 is assembled. Specifically, in the exemplary embodiment, the separator panel 140 assists with preventing the sleeve 102 from collapsing. Moreover, the separator panel 140 also prevents the first pack 150 from shifting relative to the second pack 152, thereby preventing the packs 150, 152 from becoming misaligned. As a result, the separator panel 140 prevents the first and second packs 150, 152 from inadvertently falling out of the sleeve 102. The separator panel 140 enables the sleeve 102 to have the open top end 170 and the open bottom end 172, which further reduces the amount of material used in manufacturing. Further, the inclusion of the separator panel 140 in the bundle 167 further prevents theft of a single pack by making it substantially more difficult to remove a single pack from the sleeve 102.

Figure 6:
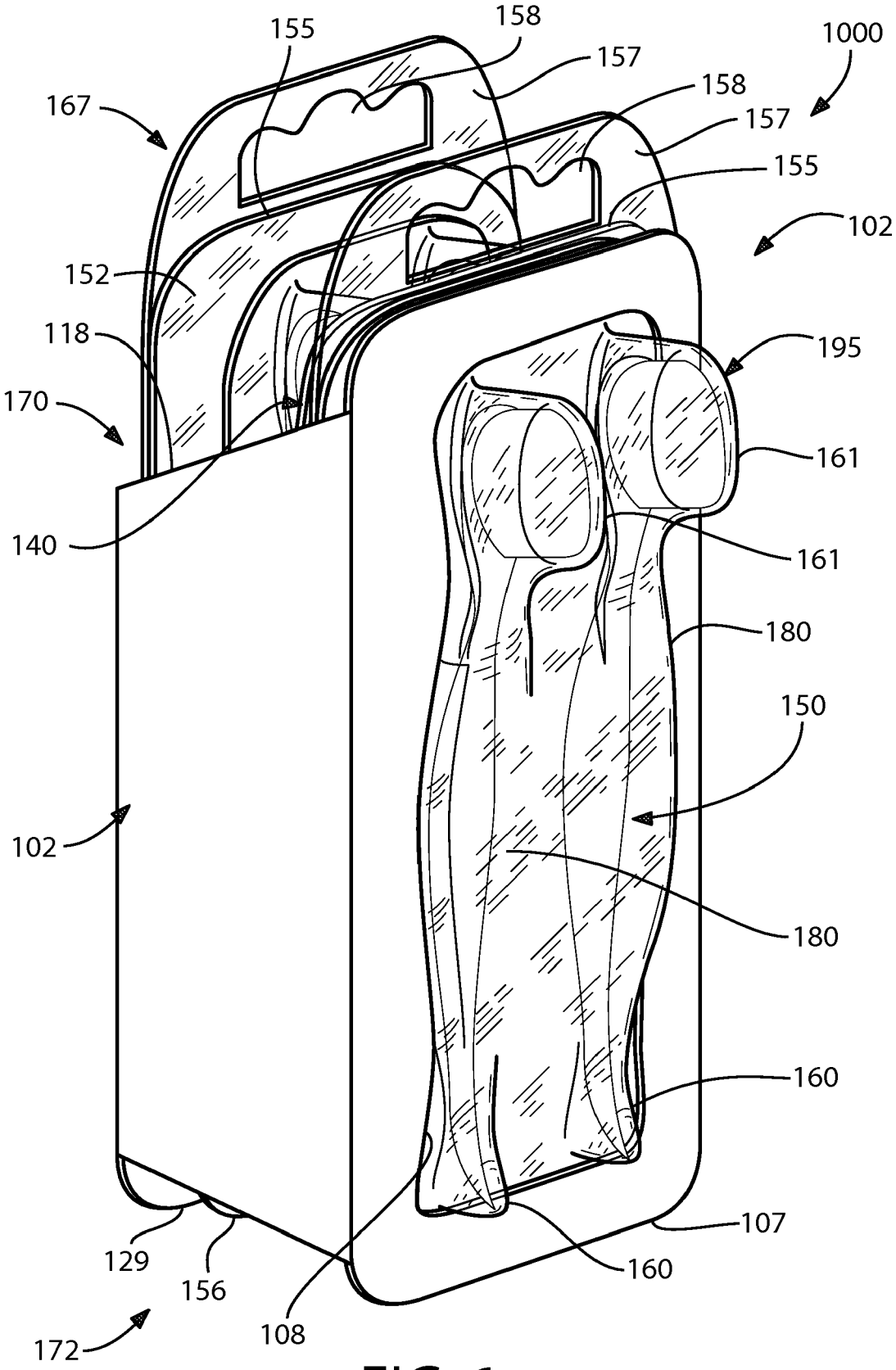
FIG. 6 is a front perspective view of a display package according to an embodiment of the present invention wherein the bundle of FIG. 3 is disposed within a sleeve formed by the carton blank of FIG. 1.
Figure 7:
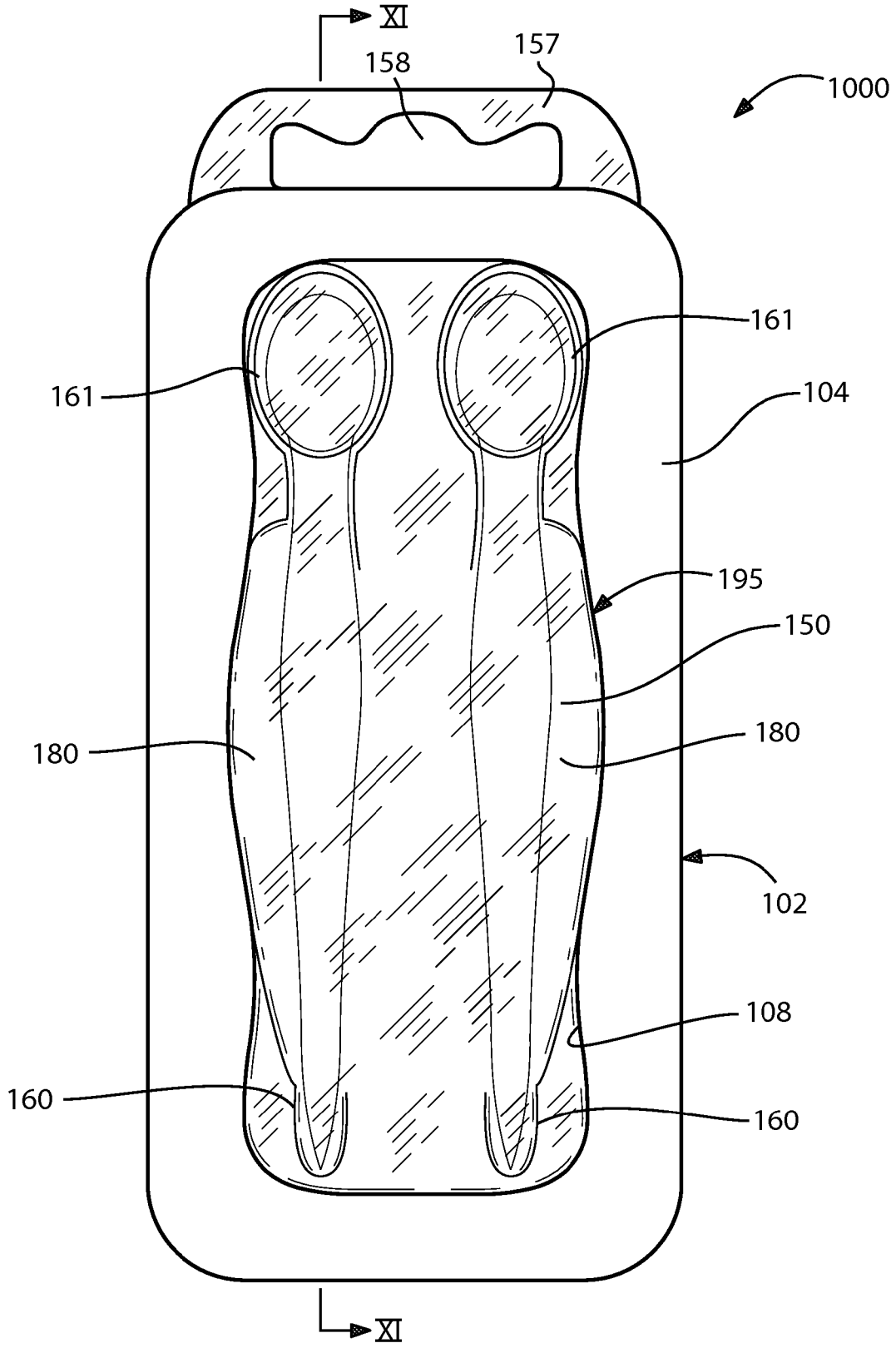
FIG. 7 is a front view of the display package of FIG. 6.
Figure 8:
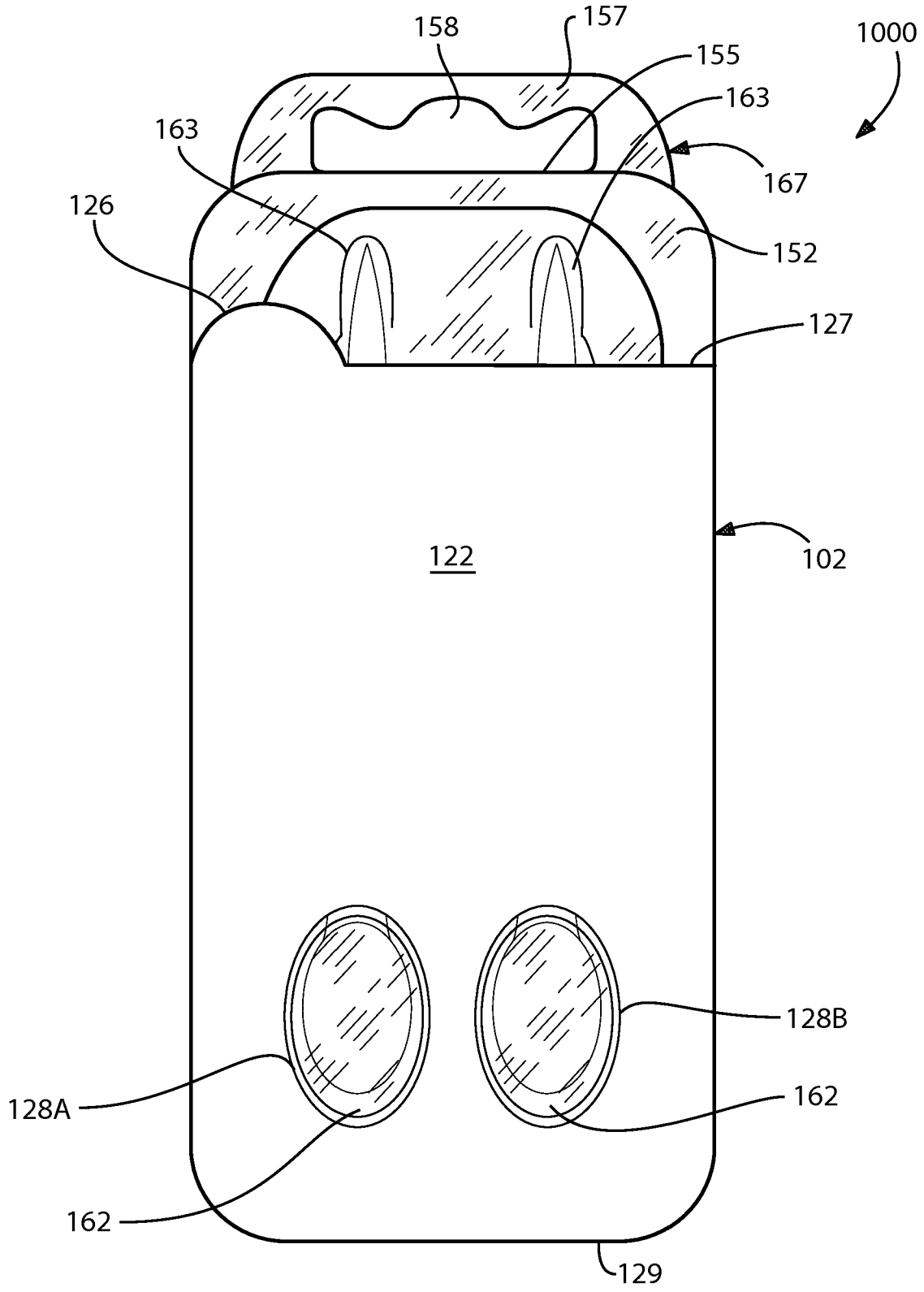
FIG. 8 is a rear view of the display package of FIG. 6.

Referring to FIG. 6, each of the packs 150, 152 comprise a top edge 155 and a bottom edge 156 and hanger tab 157 extending from the top edge 155. Each of the hanger tabs 157 include a hanging aperture 158 therein for receiving a peg or other member extending from a vertical wall so that the display package 1000 can be hung at the point-of-sale if desired.

Referring now to FIGS. 6-11 concurrently a display package 1000 according to an embodiment of the present invention is illustrated. The display package 1000 is formed by positioning the bundle 167 into the cavity 250 of the sleeve 102. As can best be seen in FIG. 11, when the bundle 167 is positioned within the cavity 250 of the sleeve 102, the packs 150, 152 are oriented so that their longitudinal axes are substantially parallel to the central axis X-X and to the front and rear panels 104, 122. For each pack 150, 152, the longitudinal axes is measured along a line extending from the top edge 155 to the bottom edge 156.

In the exemplified embodiment, because only two packs 150, 152 are used, the first pack 150 is considered a front-most pack of the bundle 167 and the second pack 152 is considered a rear-most pack of the bundle 167. Of course, when more than two packs are included in the bundle 167, middle packs will exist. Nonetheless, for purposes of describing the display package 1000 below, the first pack 150 will be referred to as the front-most pack while the second pack 152 will be referred to as the rear-most pack.

When the display package 1000 is fully assembled (as illustrated), the lower protruding sections 162 of the rear wall 154 of the rear-most pack 150 of the bundle 167 will extend through the rear apertures 128A, 128B in the rear panel 122 of the sleeve 102. Simultaneously, a protruding portion 195 of the front wall 153 of the front-most pack 150 of the bundle 167 will extend through the front aperture 108 in the front panel 104. In the exemplified embodiment, the protruding portion 195 consists of that portion of the front wall 153 of the front-most pack 150 that forms two of the interior chambers 151 in which a toothbrush 400 is fully disposed in each. Thus, the entireties of the two toothbrushes 400 are displayed via the front aperture 108. Preferably, the entirety of at least one product contained within the display package 1000 is displayed via the front aperture 108.

The protruding portion 195 includes the upper protruding portions 161 of the front wall 153 of the front-most pack 150, the lower protruding portions 160 of the front wall 153 of the front-most pack 150, and the intermediate protruding portions 180 of the front wall 153 of the front-most pack 150 (which contain the handle portion of the toothbrushes 400). Of course, the protruding portion 195 may include less than the aforementioned portions of the front wall 153 of the front-most pack 150, or may be formed by other portions of the front wall 153 of the front-most pack 150 entirely.

Figure 9:
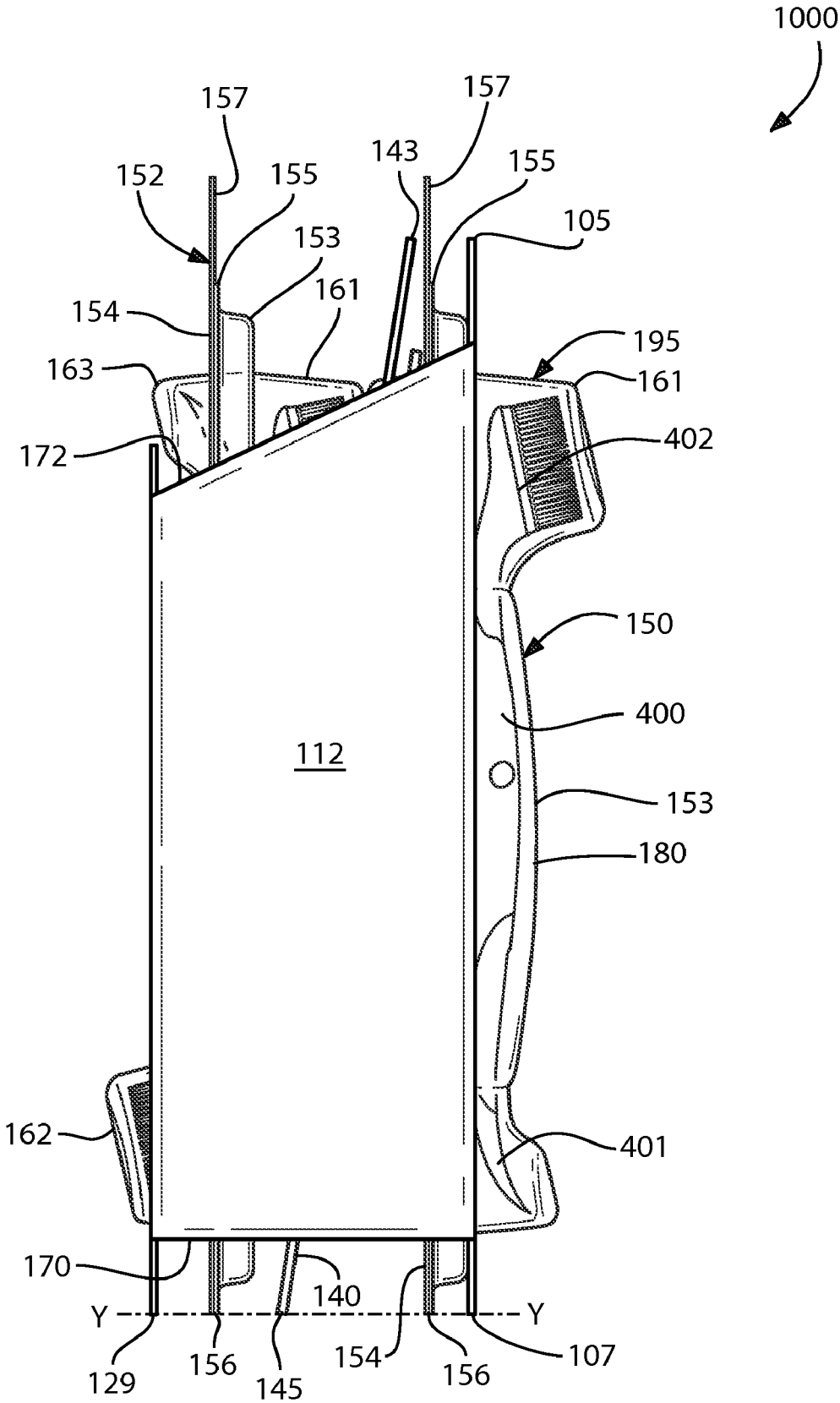
FIG. 9 is a side view of the display package of FIG. 6.
Figure 10:
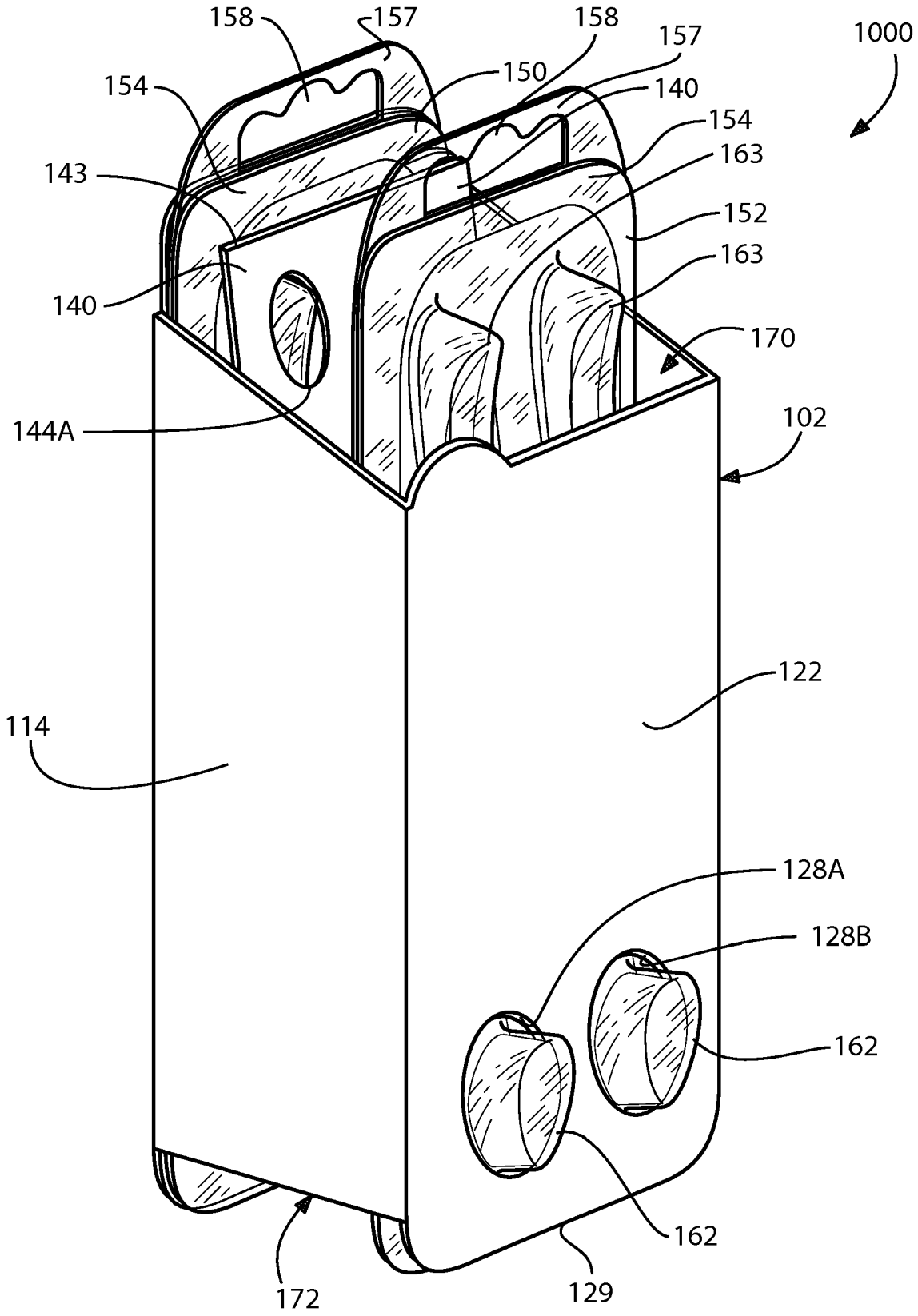
FIG. 10 is a rear perspective view of the display package of FIG. 6.

As best shown in FIGS. 9 and 10, when the display package 1000 is assembled, the bundle 167 extends from the cavity 250 of the sleeve 102 from both the open top end 170 and the open bottom end 172. In one preferred embodiment, the bottom edges 156 of the packs 150, 152 of the bundle 167 are substantially coplanar to one another and, optionally, to the bottom edges 107, 129 of the front and rear panels 104, 122 of the sleeve 102. In the exemplified embodiment, the bottom edges 156 of the packs 150, 152 and the bottom edges 107, 129 of the front and rear panels 104, 122 of the sleeve 102 all lie within the reference plane illustrated as line Y-Y. The coplanar nature of the bottom edges 156 of the packs 150, 152 and the bottom edges 107, 129 of the front and rear panels 104, 122 of the sleeve 102 provides the display package 1000 with the ability to stand upright when positioned on a horizontal surface.

While a number of embodiments of the current invention have been described and illustrated in detail, various alternatives and modifications will become readily apparent to those skilled in the art without departing from the spirit and scope of the invention. As various changes could be made in the above methods, compositions and structures without departing from the scope of the invention, it is intended that all matter contained in this application, including all mechanisms and/or modes of interaction described above, shall be interpreted as illustrative only and not limiting in any way the scope of the appended claims.

What is claimed is:

1. A display package comprising:

a plurality of packs, each pack comprising a front wall, a rear wall, and at least one interior chamber located between the front and rear walls for holding at least one product, the plurality of packs arranged in a bundle;

a separator panel having at least one upper aperture and at least one lower aperture positioned between adjacent packs in the bundle, a portion of the front wall of one pack in the bundle protruding through one of the upper or lower apertures in the separator panel and contacting an adjacent pack in the bundle and a portion of the rear wall of the adjacent pack in the bundle protruding through the other one of the upper or lower apertures in the separator panel and contacting the one pack in the bundle;

a sleeve comprising a front panel having a front aperture, a rear panel having a rear aperture, and first and second side panels connecting the front and rear panels to form a cavity; and the bundle positioned within the cavity of the sleeve, a portion of the front wall of a front-most pack in the bundle protruding through the front aperture of the front panel of the sleeve and a portion of the rear wall of a rear-most pack in the bundle protruding through the rear aperture of the rear panel of the sleeve.

2. The display package of claim 1 wherein the packs are blister packs.

3. The display package of claim 2 wherein the sleeve is a cardboard carton.

4. The display package of claim 2 wherein for each blister pack, the front wall and rear wall are hingedly connected to one another.

5. The display package of claim 4 wherein the front wall of each blister pack comprises at least one of the interior chambers and the rear wall of each blister pack comprises at least one of the interior chambers.

6. The display package of claim 1 wherein the cavity of the sleeve is formed about a central axis, the front and rear panels of the sleeve being substantially parallel to the central axis, and wherein the separator panel is oriented at an oblique angle to the central axis.

7. The display package of claim 6 wherein the separator panel has a top edge and a bottom edge, the upper aperture located adjacent the top edge of the separator panel and the lower aperture located adjacent the bottom edge of the separator panel.

8. The display package of claim 7 wherein the separator panel comprises first and second upper apertures and first and second lower apertures, the front wall of the one packs comprising first and second portions that protrude through the first and second upper apertures respectively and the rear wall of the adjacent pack comprising first and second portions that protrude through the first and second lower apertures respectively.

9. The display package of claim 8 wherein the rear panel comprises first and second rear apertures located adjacent a bottom edge of the rear panel, the rear wall of the rear-most pack having first and second portions that protrude through the first and second rear apertures respectively.

10. The display package of claim 9 wherein the entirety of one or more of the products located in the interior chamber of the front-most pack is displayed via the front aperture.

11. The display package of claim 10 wherein the bundle includes two packs, the rear-most pack being the one pack and the front-most pack being the adjacent pack.

12. The display package of claim 1 wherein the bundle includes two packs, the rear-most pack being the one pack and the front-most pack being the adjacent pack.

13. The display package of claim 1 wherein the entirety of one or more of the products located in the interior chamber of the front-most pack is displayed via the front aperture.

14. The display package of claim 1 wherein the cavity of the sleeve is formed about a central axis, the front and rear panels of the sleeve being substantially parallel to the central axis, and wherein contact between the portion of the front wall of the one pack and the adjacent pack forms a first contact interface and contact between the portion of the rear wall of the adjacent pack and the one pack forms a second contact interface, and wherein the first and second contact interfaces are at an oblique angle to the central axis.

15. The display package of claim 14 wherein the separator panel is oriented at an oblique angle to both the central axis and the first and second interfaces.

16. The display package of claim 1 wherein the sleeve has an open top end and open bottom end, the bundle protruding from the open top end and the open bottom end of the sleeve.

17. The display package of claim 16 wherein each of the packs comprises a bottom edge and a top edge, the bottom edges of the packs in the bundle being substantially coplanar with one another.

18. The display package of claim 17 wherein the front panel of the sleeve comprises a bottom edge and the rear panel of the sleeve comprises a bottom edge, the bottom edges of the front and rear panels of the sleeve being substantially coplanar with the bottom edges of the packs of the bundle.

19. The display package of claim 16 wherein each of the packs comprises a top edge, at least one of the packs of the bundle comprising a hanging tab extending from the top edge of the pack and comprising a hanging aperture, the hanging tab extending above a top edge of the front panel and a top edge of the rear panel.

20. The display package of claim 1 wherein the packs are transparent identical to one another.

21. The display package of claim 1 wherein the portion of the front wall of the one pack that contacts the adjacent pack forms a portion of the interior chamber of the one pack and the portion of the rear wall of the adjacent pack that contacts the one pack forms a portion of the interior chamber of the adjacent pack.

22. The display package of claim 1 wherein the first and second side panels are appended to opposing sides of the front panel, the rear panel appended to the first side panel and comprising a pull tab, and a glue flap appended to the second side panel that is adhered to the rear panel adjacent the pull tab.

23. The display package of claim 1 wherein the cavity of the sleeve is formed about a central axis, and wherein contact between the protruding portion of the front wall of the second pack and the first pack forms a first contact interface and contact between the protruding portion of the rear wall of the first pack and the second pack forms a second contact interface, and wherein the first and second contact interfaces are adapted to prevent relative sliding between the first and second packs in an axial direction along the central axis.

24. A display package comprising:

a plurality of packs, each pack comprising a front wall, a rear wall, and at least one interior chamber located between the front and rear walls for holding at least one product, the plurality of packs arranged in a bundle;

a separator panel positioned between adjacent packs in the bundle and having at least one aperture that allows contact between the adjacent packs in the bundle;

a tubular sleeve comprising a front panel having a front aperture and a rear panel having a rear aperture; and the bundle positioned within the cavity of the tubular sleeve, a protruding portion of the front wall of a front-most pack in the bundle protruding through the front aperture of the front panel of the tubular sleeve and a protruding portion of the rear wall of a rear-most pack in the bundle protruding through the rear aperture of the rear panel of the sleeve.

* * * * *